United States Patent [19]

Young et al.

[11] 4,291,287

[45] Sep. 22, 1981

[54] EVANESCENT MODE FILTER

[75] Inventors: Frederick A. Young; Edward L. Griffin, both of Huntington Beach, Calif.

[73] Assignee: Hughes Aircraft Company, Culver City, Calif.

[21] Appl. No.: 101,592

[22] Filed: Dec. 10, 1979

[51] Int. Cl.[3] ..... H01P 1/219; H01P 1/208

[52] U.S. Cl. ..... 333/210; 333/209; 333/212

[58] Field of Search ..... 333/208–212, 333/227–235, 248

[56] References Cited

FOREIGN PATENT DOCUMENTS 2006539 5/1979 United Kingdom ..... 333/210

*Primary Examiner*—Marvin L. Nussbaum

*Attorney, Agent, or Firm*—John Holtrichter, Jr.; William H. MacAllister

[57] ABSTRACT

There are herein described evanescent mode filters each of which include a hollow waveguide, wherein a plurality of resonators are disposed, the resonators including loading structures such as tuning screws, for example, wherein at least one of the loading structures is angularly disposed, relative to the axis of the waveguide, with respect to others of the loading structures to reduce the length of the filter and/or to provide internal bridge couplings.

3 Claims, 7 Drawing Figures

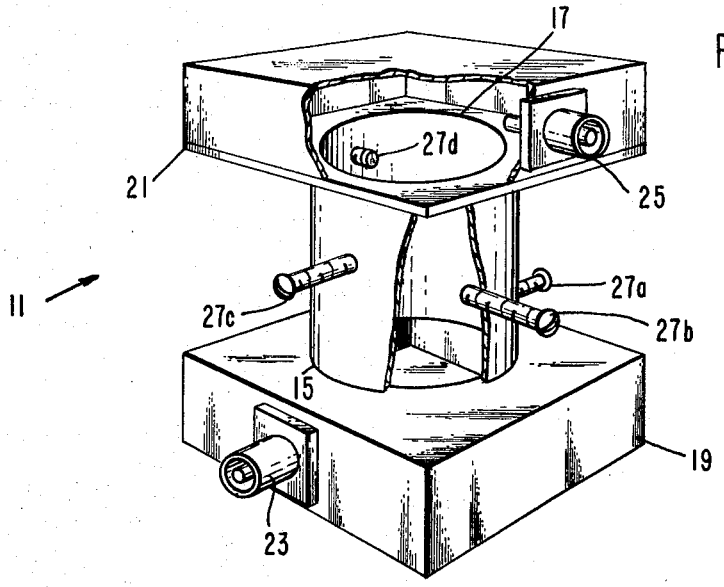
Fig. 1.
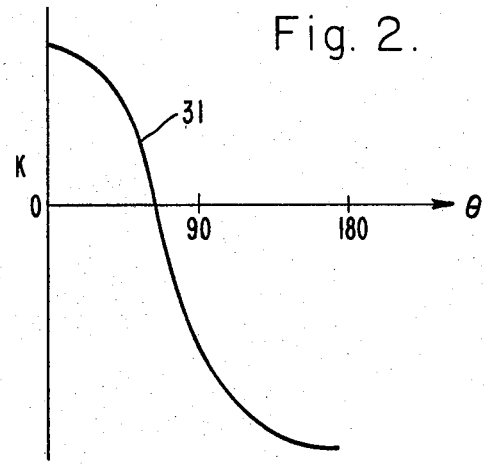
Fig. 2.
Fig. 3.
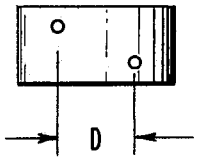
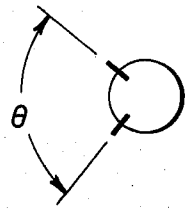
Fig. 4.

EVANESCENT MODE FILTER

TECHNICAL FIELD

This invention relates to ultrahigh and microwavefrequency bandpass filters, and more particularly to evanescent mode filters.

BACKGROUND ART

Standard evanescent mode bandpass filters are well-known in the art. These devices utilizes parallel resonators with inherent relatively large coupling for a given spacing.

In many applications, bridge coupled response has been found to be desirable and has been achieved in a folded evanescent structure at the expense of a relatively large size and added complexity. In other applications, it has been found desirable to shorten the length of an evanescent mode filter without utilizing the aforementioned folded design.

Extension descriptions of evanescnet mode filters are readily available in the literature and may be obtained by referring to such publications as, for example, an article entitled, "New Application of Evanescent Mode Waveguide to Filter Design," by Richard V. Snyder, in IEEE-MTT-25, December 1977, pages 1013–1021.

SUMMARY OF THE INVENTION

In view of the foregoing factors and conditions characteristic of the prior art, it is a primary object of the present invention to provide a new and improved evanescent mode filter.

Another object of the present invention is to provide an efficient and relatively compact evanescent mode filter.

Still another object of the present invention is to provide internal bridge coupled evanescent mode filters.

Yet another object of the present invention is to provide evanescent mode filters which are shortened by using non-parallel resonators.

Still a further object of the present invention is to provide an evanescent mode bandpass filter capable of a variety of internal diagonal and canonical bridge couplings which allow elliptic and self equalized designs.

In accordance with an embodiment of the present invention, an evanescent mode filter includes a waveguide member dimensioned below cutoff at the operating frequency of the filter, the waveguide member including a side wall and an input end and an opposite output end. Input and output coupling circuits are associated with the input and output ends of the waveguide member for respectively coupling RF energy into and out of the evanescent mode filter. A plurality of evanescent resonators are disposed in the waveguide member, and an evanescent resonator loading structure, such as a tuning screw, is disposed in each of the evanescent resonators extending therein through the side wall of the waveguide member. The loading structures are oriented about the axis of the waveguide member at an angle with respect to at least one other of the loading structures.

Selected ones of the none-adjacent evanescent resonators in the filter may form internal bridge couplings, and tuning screws may lie generally along a helical path about a cylindrical side wall of a cylindrical waveguide member. Alternately, the waveguide member may be rectangular, and the loading structures, such as tuning screws, may be located in the same side wall or in different side walls of the waveguide member.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a perspective view of an evanescent mode filter constructed in accordance with the present invention;

FIG. 2 is a graph showing a typical coupling curve for, coupling (K) versus relative angular displacement (O) of the tuning screws of the device of FIG. 1;

FIGS. 3 and 4 are, respectively, partial elevation and plan views of a pair of adjacent tuning screws showing the separation distance and angular rotation relationship between the tuning screws in the filter seen in FIG. 1;

DETAILED DESCRIPTION OF THE INVENTION

Figure 5:
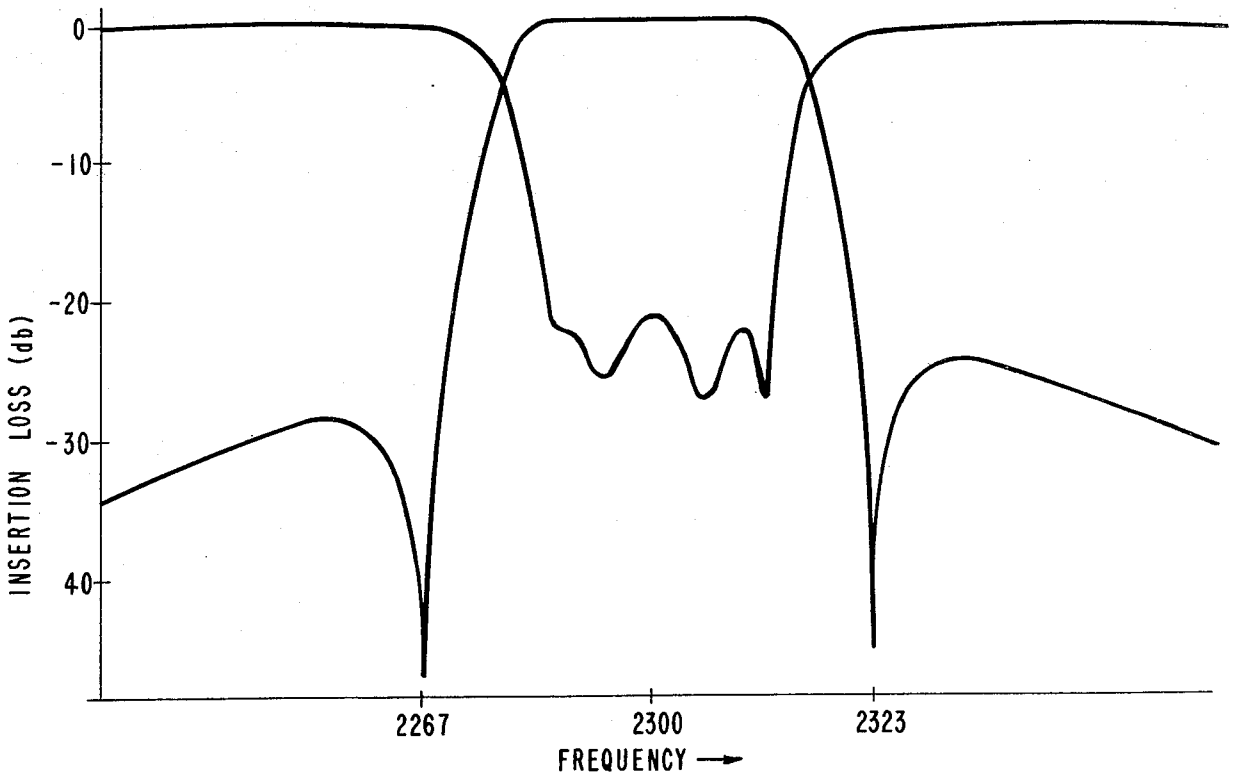
FIG. 5 is a graph showing the insertion loss and return loss versus frequency for the four section evanescent mode filter of FIG. 1.

Referring now to the drawings and more particularly to the FIG. 1, there is shown a perspective view of a four-section evanescent mode filter 11 constructed in accordance with a presently preferred embodiment of the invention.

The filter 11 includes a waveguide member 13 having an input end 15 and an output end 17, and also includes respective coupling enclosures 19 and 21 on which are mounted conventional input and output coaxial connectors 23 and 25. The hollow waveguide member 13 has an inner dimension such that the waveguide will not propagate electromagnetic energy therealong, i.e., below cutoff, at the operating frequency of the filter. The waveguide member is also longitudinally dimensioned, in conjunction with the loading structures, to support a plurality of evanescent resonators, as is well-known in the art.

Further, the invention includes at least one evanescent resonator loading structure, such as tuning screws 27, for example, in each of the evanescent resonators.

In a conventional evanescent mode filter, the loading structures 27 would all be in line and, thus, the resonators would all be in parallel to provide a predetermined coupling for a given resonator spacing. Also, in the conventional configuration, no internal bridge couplings are possible.

In contrast to the prior art, the evanescent resonator loading structures are oriented about the axis of the waveguide member at an angle with respect to at least one other of such loading structures so as to produce a non-parallel resonator configuration which has reduced coupling for a given spacing. Thus, for a given maximum coupling, the filter 11, with each of its tuning screws 27 angularly disposed to each other, can be a factor of two or more shorter than a standard evanescent mode filter, and with no degradation in performance.

Furthermore, another advantage of the invention is that a variety of diagonal and canonical bridge couplings are available internally, which allow elliptic and self-equalized designs to be realized. Bridge coupled response has been found to be very desirable in many applications, and the ability to provide such coupling internally constitutes a great advantage since such coupling in the past was only achievable in a folded evanescent structure at the expense of larger size and added complexity.

In a standard evanescent mode filter, the coupling can only be positive, while in the invention, the coupling generally follows a curve 31 as shown in the graph of FIG. 2. It can be seen from this figure and FIGS. 3 and 4 that the typical coupling curve 31 for the evanescent mode filter, in accordance with the invention, crosses zero coupling at a particular axial angular relationship, O, between the evanescent resonator loading structures at a fixed separation distance, D. And, in fact, the coupling becomes negative beyond that point. Stated in another way, at constant spacing, D, the coupling, K, is a function of the angle, $\theta$, and as shown in the graph, it goes through a sign change at approximately 60 degrees. Thus, by placing adjacent resonators at nearly 60 degrees (in this example) with respect to each other, the resonators must move much closer to achieve a given coupling, and non-adjacent resonators may form internal bridge couplings.

FIG. 5 is provided to show a typical elliptic response of the evanescent mode filter 11 constructed to operate at 2.6 GHz.

Figure 6:
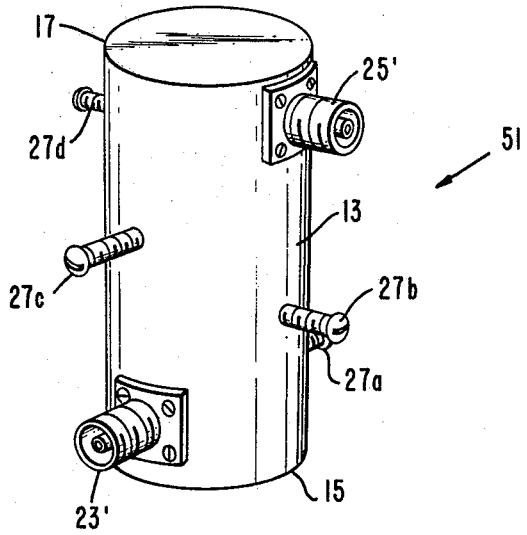
FIG. 6 is a perspective view of the invention which is similar to that shown in FIG. 1, but with the coaxial input and output connectors mounted directly on the cylindrical waveguide member side wall.

In accordance with another embodiment of the invention, as shown in FIG. 6, an evanescent mode filter 51 may be constructed which duplicates the performance of filter 11 of FIG. 1, but does not include the enclosure 19 and 21. In the filter 51, the coaxial connectors are mounted directly on the waveguide member 13 to illustrate that the often used enclosures are not needed for proper operation of the device.

Figure 7:
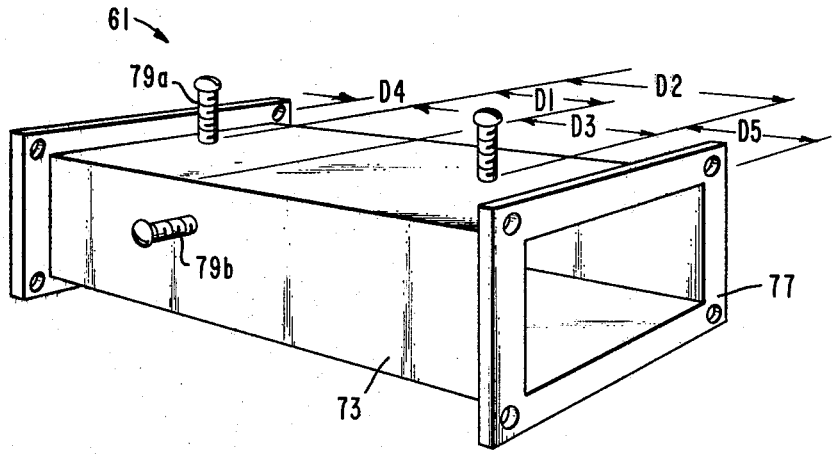
FIG. 7 is a perspective illustration of yet another embodiment of the present invention, one in which the waveguide member has a rectangular cross section.

Referring now to yet another embodiment of the invention, there is shown in FIG. 7 a evanescent mode filter 61 that includes a rectangular waveguide member 73, an input end and flange portion 75, an output end and flange portion 77, and three evanescent resonator loading structures or tuning screws 79*a*, 79*b*, and 79*c*. The internal dimension of the waveguide member 73 is such that it is below cutoff at the filter frequency, and the tuning screws 79 are not in line. As previously noted, in order to obtain the advantages of the invention, at least two of the resonators in the waveguide member must not be in parallel, and this condition is provided by not locating all of the evanescent resonator loading structures in line with each other.

In the embodiment of FIG. 7, the first and second tuning screws are located on different sides of the guide, and the third adjustable screw is located on the same side as the first, but angularly displaced therefrom. In all other respects, this embodiment is similar functionally to the embodiments previously described. The non-alignment of at least two of the loading structures causes the coupling, K, to generally follow the curve 31 in FIG. 2, and lessens the coupling for a given separation distance, D.

Where it is desired that the input and output impedances not be the same, the distance D3, between the input flange 75 and the first tuning screw 79*a*, can be made different that the distance, D4, between the third tuning screw 79*c* and the output flange 77.

From the foregoing, it should be evident that there has herein been described a highly advantageous and unique evanescent mode filter in which the coupling between evanescent resonators, for any predetermined distance, will follow a curve similar to that shown in FIG. 2, depending upon the angular relationship of the resonator loading structures relative to the axis of the waveguide. This allows the axial length of the filter to be lessened and/or allows the achievement of internal bridge couplings between other than adjacent evanescent resonators.

Although several embodiments of the invention have been described in detail, it will be apparent to those skilled in the art that various changes and modifications may be made therein without departing from the spirit and scope of the invention. Further, it should be understood that structures equivalent in function to those described may be substituted therefor. For example, other types of evanescent resonator loading structures, fixed or tunable, may be substituted for the tuning screws shown.

What is claimed is:

1. An evanescent mode filter for ultra-high and microwave frequency bandpass filter applications, comprising:

a hollow waveguide member dimensioned below cutoff at an operating frequency, said waveguide member including a side wall and an input end and an opposite output end;

input/output coupling means associated with said input and output ends of said cylindrical waveguide member for respectively coupling RF energy into and out of said evanescent mode filter;

a plurality of evanescent resonators disposed in said waveguide member, alternate ones of said resonators forming internal bridge couplings; and an evanescent resonator loading structure disposed in each of said evanescent resonators, at least one of said loading structures being oriented about the axis of said waveguide member at an angle with respect to at least one other of said loading structures.

2. An evanescent mode filter for ultra-high and microwave frequency bandpass filter applications, comprising:

a hollow waveguide member dimensioned below cutoff at an operating frequency, said waveguide member including a side wall and an input end and an opposite output end;

input/output coupling means associated with said input and output ends of said cylindrical waveguide member for respectively coupling RF energy into and out of said evanescent mode filter;

a plurality of evanescent resonators disposed in said waveguide member; and an evanescent resonator including structure disposed in each of said evanescent resonators, at least one of said loading structures being oriented about the axis of said waveguide member at an angle with respect to at least one other of said loading structures and generally lying on a helical path about said side wall of said waveguide member.

3. An evanescent mode filter for ultra-high and microwave frequency bandpass filter applications, comprising:

a hollow cylindrical waveguide member dimensioned below cutoff at an operating frequency, said waveguide member including a side wall and an input end and an opposite output end;

input/output coupling means associated with said input and output ends of said cylindrical waveguide member for respectively coupling RF energy into and out of said evanescent mode filter;

a plurality of evanescent resonators disposed in said waveguide member, alternate ones of said resonators forming internal bridge couplings; and an evanescent resonator loading structure disposed in each of said evanescent resonators, at least one of said loading structures being oriented about the axis of said waveguide member at an angle with respect to at least one other of said loading structures.

* * * * *